United States Patent [19]

Beck

[11] Patent Number: 4,591,765

[45] Date of Patent: May 27, 1986

[54] LAMP CONTROL

[76] Inventor: Gregory M. Beck, 24185 Zancon, Mission Viejo, Calif. 92692

[21] Appl. No.: 547,063

[22] Filed: Oct. 31, 1983

[51] Int. Cl.[4] ..... H05B 37/02; H05B 39/04

[52] U.S. Cl. ..... 315/361; 315/362; 307/114; 307/140

[58] Field of Search ..... 315/361, 362, 127, 136; 307/157, 114, 140

[56] References Cited

U.S. PATENT DOCUMENTS

| | | | |
|---|---|---|---|
| 3,234,342 | 2/1966 | Murray | 307/114 |
| 3,372,302 | 3/1968 | Fasola | 200/51.14 |
| 3,418,489 | 12/1968 | Platzer, Jr. | 307/114 |
| 3,496,379 | 2/1970 | Platzer, Jr. | 307/114 |
| 3,514,626 | 5/1970 | Platzer, Jr. | 307/114 |
| 3,872,319 | 3/1975 | Platzer, Jr. | 307/114 |
| 4,090,107 | 5/1978 | Seib | 315/361 X |
| 4,104,540 | 8/1978 | Lien | 315/361 X |
| 4,155,015 | 5/1979 | Nakasone et al. | 315/361 X |
| 4,211,959 | 7/1980 | Deavenport et al. | 315/362 |
| 4,250,432 | 2/1981 | Kohler | 315/362 X |
| 4,525,634 | 6/1985 | Southard | 315/361 X |

OTHER PUBLICATIONS

"Touch Lamp", *Hobby Electronics,* vol. 3, No. 12, pp. 51–52, Oct. 1981.

"Reciprocating Touch Switch", *Practical Electronics,* Mar. 1976, p. 235.

*Primary Examiner*—David K. Moore

*Assistant Examiner*—Vincent DeLuca

*Attorney, Agent, or Firm*—Hubbard, Stetina & Brunda

[57] ABSTRACT

This invention is an electronic lamp control circuit for connection between a lamp bulb and a wall receptacle controlled by a wall switch. The lamp control circuit includes switching circuitry which permits complete control of the lamp from either the wall switch or a switch included in the lamp control circuit. The lamp control circuit permits a user to turn off the lamp by actuating the wall switch and to later turn on the lamp by actuating the lamp control switch and to turn off the lamp with the lamp control switch and later turn on the lamp using only the wall switch.

7 Claims, 6 Drawing Figures

Fig. 1
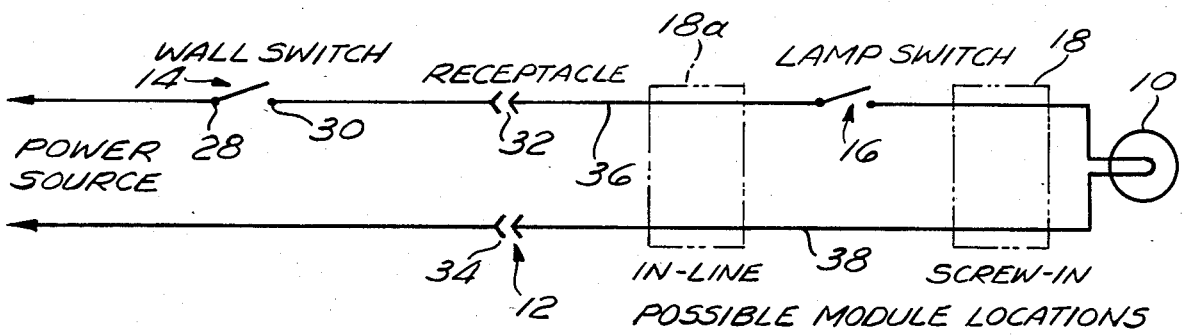
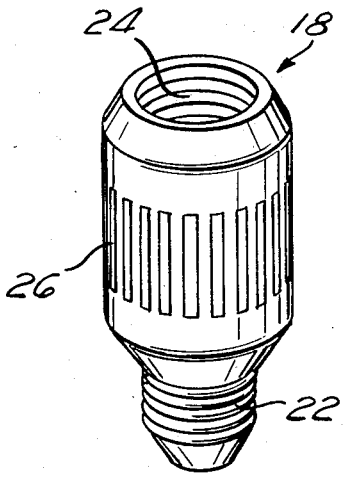
Fig. 2a
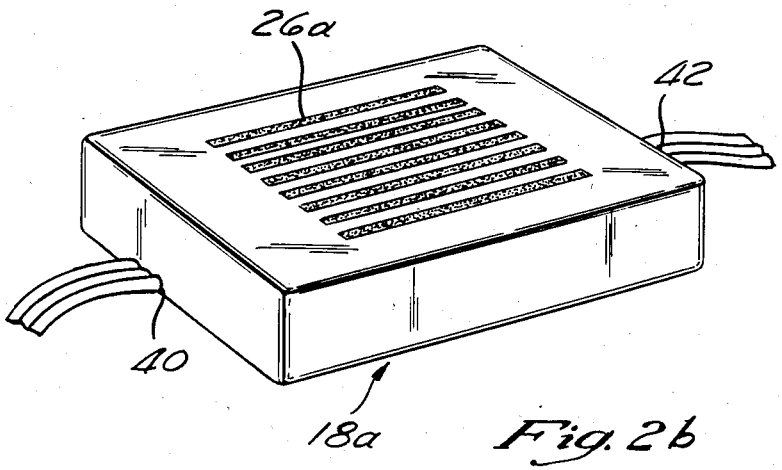
Fig. 2b

LAMP CONTROL

BACKGROUND OF THE INVENTION

This invention relates generally to electrical circuits for controlling lamps and more particularly to a circuit for resetting the switch of a lamp so that the lamp may be turned on by actuating a remote electrical power switch after the lamp has been turned off at the lamp switch.

In most new housing construction certain rooms, such as bedrooms, ordinarily have no overhead electrical lighting. Electrical lighting in such rooms is obtained by installing a lamp connected to a standard wall plug to supply electrical power to the lamp. A manually activated wall switch controls the flow of electrical power to the wall plug so that the switch must be in the on position in order to turn on the lamp. The lamp ordinarily includes a lamp switch that must also be in the on position for the electric light bulb in the lamp receives electrical power. A person going to bed at night might turn off the lamp by moving the lamp switch to the off position, leaving the wall switch in the on position. If the lamp switch is not subsequently moved to the on position, then a person entering the room will be unable to turn on the lamp by actuating the wall switch. It is therefore necessary to walk into the room, which may be darkened, in order to gain access to the lamp switch to turn on the lamp. Entering a darkened room is inconvenient and may be dangerous.

SUMMARY OF THE INVENTION

This invention provides a small, self-contained electronic lamp control circuit for connection between a lamp bulb and a wall receptacle that is controlled by a wall switch. The invention provides for complete control of the lamp from either the wall switch or the lamp control circuit. The invention also may include a dimming control that may be actuated from either the wall switch or the lamp control circuit.

The lamp control circuit according to the invention may be packaged as a screw-in module that is placed between the bulb and the existing socket of a lamp fixture. The lamp control circuit may also be packaged as a module for connection in-line with the lamp cord that connects the lamp to the wall socket.

The lamp control circuit provides means by which a user may turn off the lamp by actuating the wall switch and may later turn on the lamp by actuating the module switch. The user may turn off the lamp with the module switch and later turn on the lamp using only the wall switch.

The invention also may include a dimmer control circuit that provides control of the lamp current and, consequently, the brightness of the lamp bulb.

BRIEF DESCRIPTION OF THE DRAWINGS

FIG. 1 is a schematic diagram illustrating installation locations for a lamp control circuit according to the invention in a circuit for supplying electrical power to an electric lightbulb;

FIGS. 2*a* and 2*b* illustrate possible configurations of the lamp control circuit module for screw-in installation in a lamp socket and for installation in-line between a lamp switch and an electric wall receptacle;

DESCRIPTION OF THE PREFERRED EMBODIMENT

Figure 3:
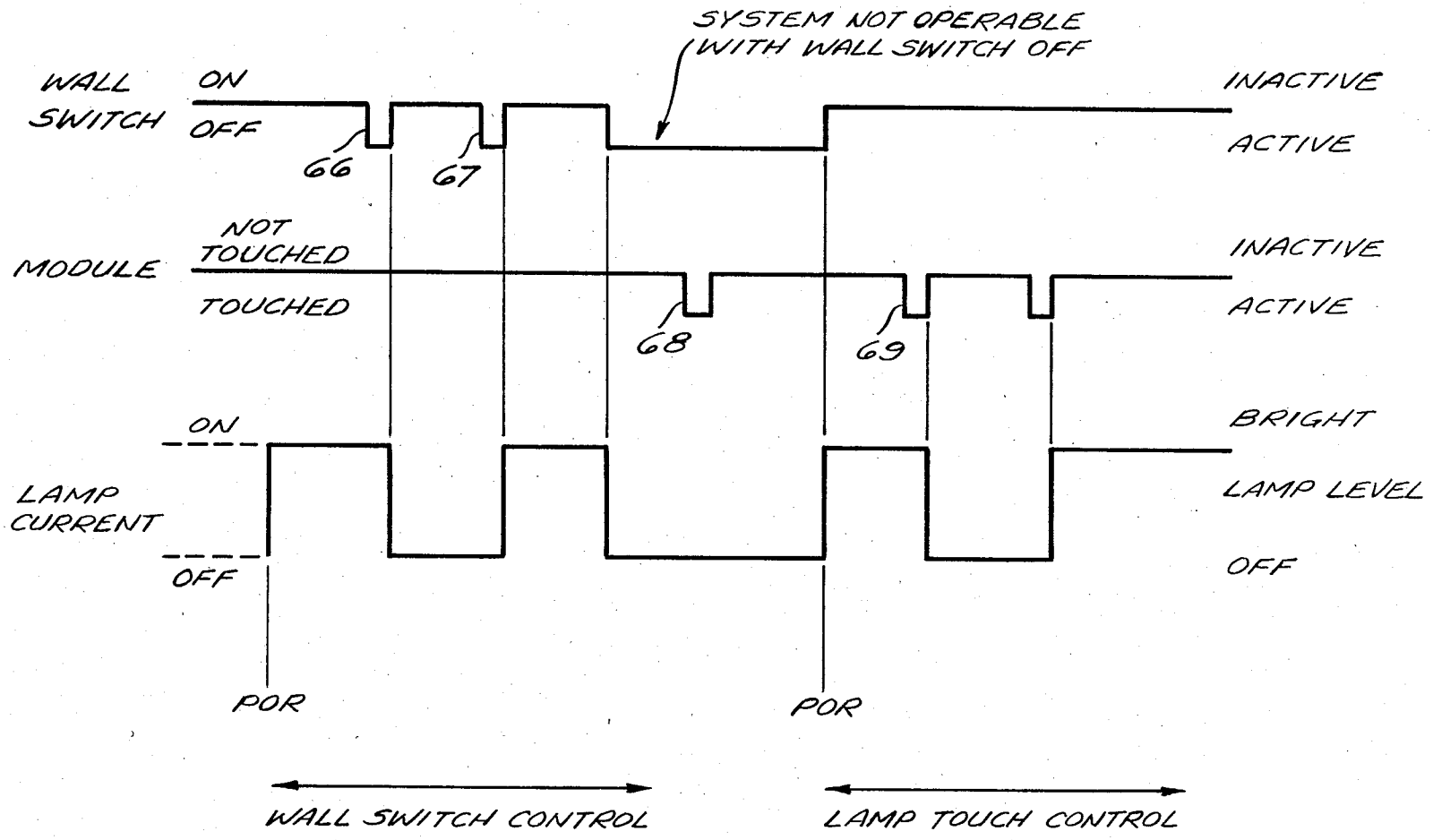
FIG. 3 is an on/off operating state diagram of the lamp control circuit of the invention without a dimmer control.

FIG. 1 illustrates a lamp bulb 10 connected through a lamp switch 16 to a wall receptacle 12 that is controlled by a wall switch 14. A lamp control module 18 shown in phantom lines may be connected between the lamp 10 and the lamp switch 16 or between the lamp switch 16 and the wall receptacle 12.

Referring to FIG. 2*a*, an exemplary preferred embodiment of the lamp control module 18 has a male threaded end 22 configured for threaded engagement in an ordinary Edison lamp socket (not shown) and a female threaded end 24 for receiving the lamp bulb 10 therein. The lamp control module 18 includes a touch switch 26 for controlling the flow of electrical current to the lamp bulb 10.

FIG. 2*b* illustrates the second preferred embodiment of a lamp control module 18*a* for connection in line between the wall receptacle 12 and the lamp switch 16. The control module 18*a* has a pair of electrical terminals 40 and 42 for connection to the wires 36 and 38. The control module 18*a* includes a touch control switch 26*a* similar to the touch control switch 26 of the control module 18.

FIG. 1 illustrates connection of the wall switch 14, the wall receptacle 12, the lamp 10 and the control module 18 to a source of electrical power (not shown). For simplicity the wall switch 14 is shown to be single-pole, single-throw switch; but the wall switch 14 may also be a double-pole single-throw switch or any other suitable switch. In the illustrated embodiment, the wall switch 14 has a first pole 28 connected to the power source and a second pole 30 connected to terminal 32 of the wall receptacle 12. A second pole 34 of the wall receptacle 12 is connected directly to the power source. A wire 36 extend between the wall receptacle 12 and the lamp switch 16, which is also conveniently shown to be a single-pole single-throw switch; and a wire 38 extends between the wall receptacle 12 and the control module 18 when the control module 18 is mounted between the lamp bulb 10 and the lamp switch 16.

Figure 5:
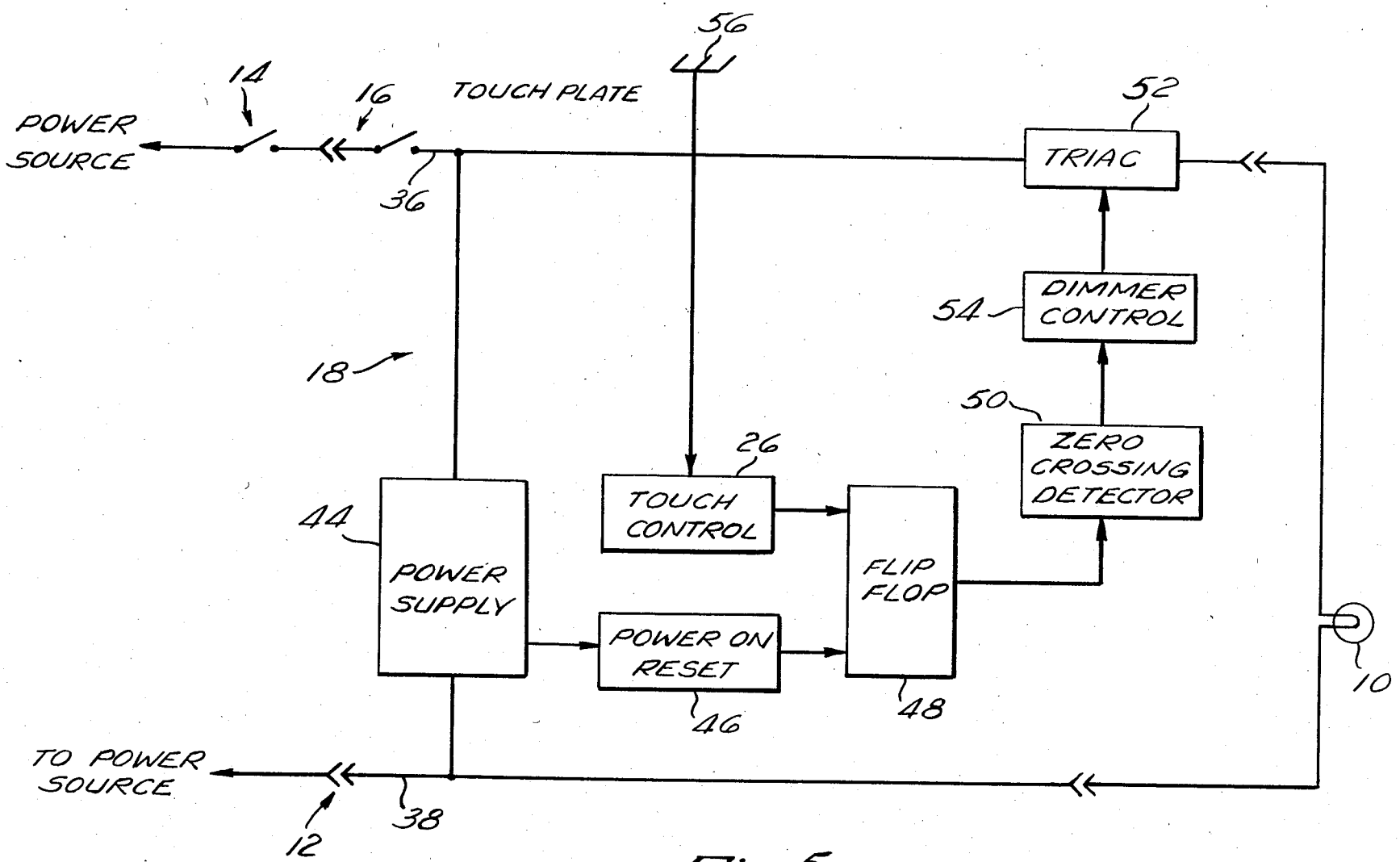
FIG. 5 is a block diagram of a lamp control circuit according to the invention.

Referring to FIG. 5, the control module 18 is shown connected between the lamp bulb 10 and the lamp switch 16, which is normally in the on position. The control module 18 includes a power supply 44 that is connected between the wires 38 and the lamp switch 16, which are connected to the wall receptacle 12. The power supply 44 provides electrical power to a power on-reset switch 46 for application to a flip-flop 48. The flip-flop 48 also receives an input from the touch control switch 26. The output of the flip-flop 48 is supplied to a zero crossing detector 50 having an output connected to a triac 52 which is connected to the lamp bulb 10. The power supply 44 provides a temporary power capability by utilizing conventional means such as a charged capacitor (not shown) to supply electrical power to the flip-flop after the wall switch 14 has been actuated to interrupt the flow of electrical power to the lamp bulb 10. Maintaining a supply of electrical power to the power on-reset 46 and the flip-flop 48 causes these components to remain active in controlling the future conductive state of the triac 52 according to inputs from the wall switch 14 or the touch control 26. The power supply 44 should supply sufficient power to maintain the power on-reset 44 and the flip-flop 48 active for a period of 2–4 seconds.

When the user desires to turn off the lamp bulb 10 using the wall switch 14, the wall switch 14 is flashed, or turned off momentarily and then turned on again. The duration of the flash should be approximately one-half to one second in order to the give the flip-flop 48 adequate time to change output states.

Ordinarily, the wall switch 14 is in the on position to leave the wall receptacle 12 energized because unless the wall receptacle 12 is energized, no electrical power will flow therefrom to the lamp bulb 10. Flashing the wall switch 14 causes an intermittent interruption in power to the wall receptacle 12 and to the lamp control module 18 connected thereto. Flashing the wall switch 14 toggles the state of the flip-flop 48 to control application of energy to the lamp bulb 10. If the lamp bulb 10 is de-energized, or off, prior to a flash, then after the flash, the lamp bulb 10 is energized. Similarly, if the lamp bulb 10 is energized prior to a flash, the flash will toggle the flip-flop 48 to de-energize the lamp bulb 10 after the flash.

The user merely touches a touch plate 56 of the touch control 26 to cause the touch control 26 to output a signal that toggles the flip-flop 48.

The lamp control module 18 may include a dimming control circuit 54 connected between the zero crossing detector 50 and the triac 52. The output of the dimming control circuit 54 is a ramp signal which controls the output of the triac 52 to the lamp bulb 10. Operation of the dimming control 54 is similar to that of the on/off operation described above except that two flashes are required to control the dimming. The first flash starts the dimming control circuit, which ramps, or slowly adjusts, current to the lamp bulb 10. The second flash latches the dimmer control circuit 54 to maintain the lamp current at a constant effective value, thereby maintaining a constant light intensity output from the lamp bulb 10.

Figure 4:
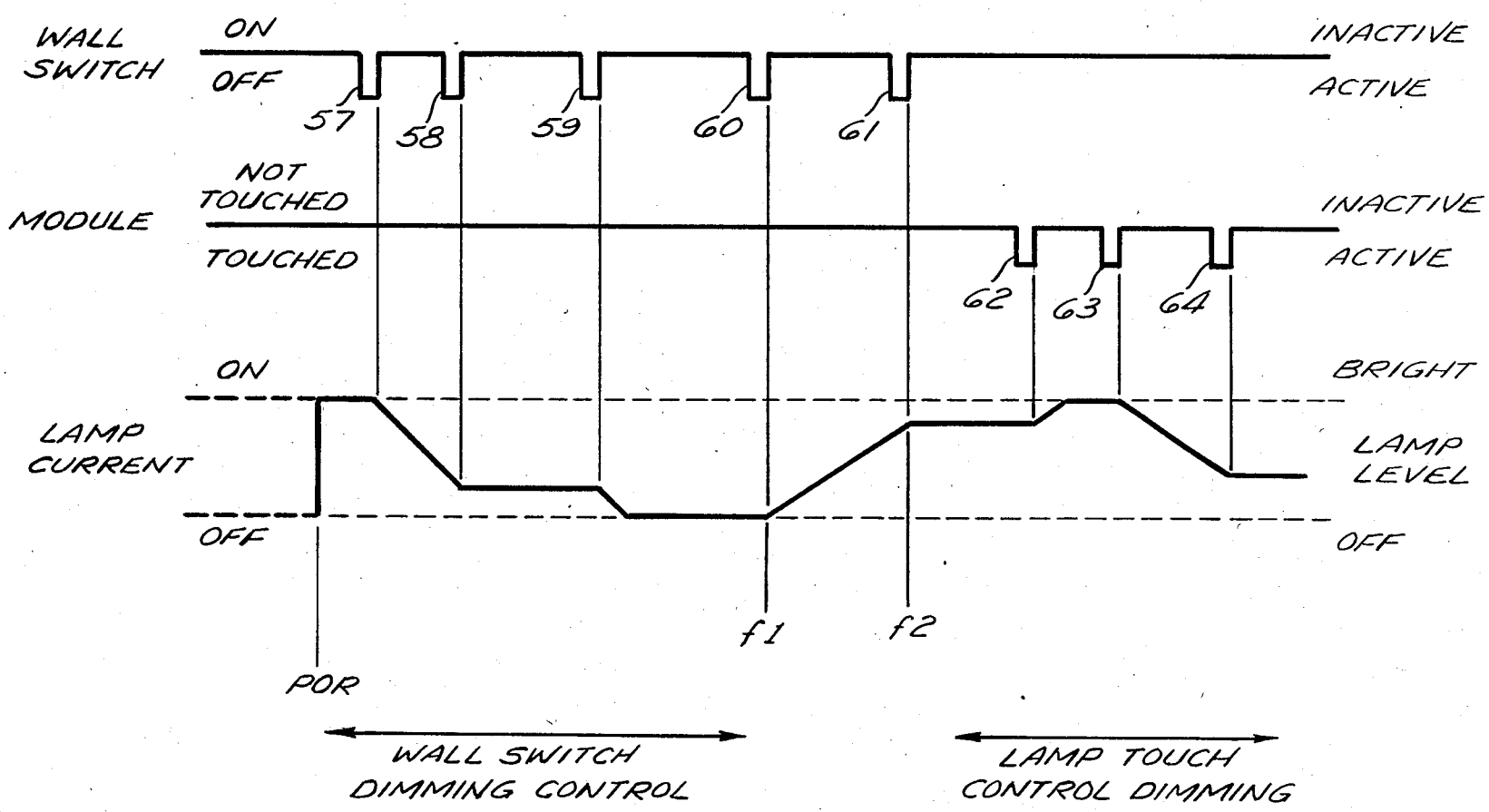
FIG. 4 is an on/off operating state diagram of a lamp control circuit according to the invention including a dimmer control.

Periods in which the wall switch 14 is off are represented as pulses in FIGS. 3 and 4. Referring to FIG. 4, the wall switch 14 is normally on and a plurality of negative pulses 57–61 indicate periods during which the wall switch 14 is turned off for brief periods. Ordinarily the control module 18 is not touched while the wall switch 14 is being actuated. If the current to the lamp bulb 10 is at a maximum value with the wall switch 14 on, then flashing the wall switch 14 to produce the pulse 57 causes the effective value of the current to decrease until the second flash of the wall switch 14 produces the pulse 58, which then clamps the lamp current at a steady value until the wall switch 14 is flashed again to produce the pulse 59. The pulse 59 causes the lamp current to decrease at a uniform rate until the current amplitude becomes zero, indicating that the lamp bulb 10 is completely de-energized. The lamp bulb 10 remains de-energized until the wall switch 14 is flashed again to produce the pulse 60 which causes the lamp current to increase from its preceding value until the wall switch 14 is again flashed to produce the pulse 61, which causes the lamp current to remain fixed.

It is possible to actuate the dimming control 54 through the lamp control module 18. Touching the touch plate 56 of the control circuit 26 forms a pulse 62 which toggles the flip-flop 48, causing the lamp current to increase to its maximum value. The current remains constant until the touch plate 56 is again touched to produce a pulse 63 which causes the current to decrease, thereby dimming the lamp bulb 10. Touching the touch plate 56 a third time produces a pulse 64 which clamps the lamp current at a fixed level until subsequent actuation of either the wall switch 14 or the touch control circuit 26.

FIG. 3 is an operating state diagram for the circuit which does not include the dimming control 54. If the lamp control module 18 does not include the dimmer control 54, then the output of the zero-crossing detector controls whether the triac 52 is on to supply current to the lamp bulb 10 or off to interrupt current flow to the lamp bulb 10. The wall switch 14 and the lamp switch 16 are normally in the on positions, and flashing the wall switch 14 produces a pulse 66 that causes the lamp current to decrease from its maximum value to zero. The current remains at zero until a second flashing of the wall switch 14 produces a pulse 67 to toggle the flip-flop 48 to switch the triac 52 to a conducting state. When the wall switch 14 remains in the off position, the system is not operable and the lamp current is zero. Touching the touch plate 56 to produce a pulse 68 when the wall switch 14 is off fails to energize the lamp bulb 10 because no current reaches the lamp bulb 10 when the wall switch remains in the off position. Similarly, the lamp switch 16 must always be in the on position. When the wall switch 14 is placed in the on position again, the lamp current switches from zero to the maximum value until the touch control 56 is actuated to produce a pulse 69 that toggles the flip-flop 48 to switch the triac 52 to a nonconductive state. Subsequent actuation of the touch control produces a pulse 70 that toggles the flip-flop 48 to produce an output that switches the triac 52 to a conductive state so that the lamp current again switches from zero to its maximum value.

What is claimed is:

1. A system for controlling application of electrical current to a lamp or the like connected to a conventional wall receptacle controlled by a wall mounted power switch for controlling the application of an electrical power source to said wall receptacle, comprising:

a control module formed to be connected between the wall receptacle and the lamp without modifying the wiring between said wall receptacle and said wall mounted power switch said control module further comprising:

an AC-power supply for connection to the power switch;

a power on-reset circuit connected to the power supply to receive electrical power therefrom for producing a reset signal in response to momentary interruption and immediate subsequent resumption of application of electrical power from the source of electrical power to the power supply;

control switch means responsive to actuation by a user for producing a control signal;

switching means responsive to the reset signal and the control signal for producing a switching signal; and means responsive to the switching signal for controlling the magnitude of electrical current supplied to the lamp from the source of electrical power so that the lamp may be selectively energized by either the control switch means or the power switch after having been de-energized by either the control switch means or the power switch.

2. The system of claim 1 wherein the switching means comprises a flip-flop and wherein the means responsive to the switching signal for controlling the magnitude of electrical current supplied to the lamp from the source of electrical power comprises:

a zero crossing detector connected to receive the output of the flip-flop, the zero crossing detector producing an output signal in response to toggling of the flip-flop output signal; and an electrically controllable current regulating means for connection between the source of electrical power and the lamp, said electrically controllable current regulating means being responsive to the output of the zero crossing detector to switch between a conductive state for applying electrical current to the lamp and a non-conductive state for preventing application of electrical current to the lamp.

3. The system of claim 2 further comprising a dimmer control circuit connected between the zero crossing detector and the current regulating means, the dimmer control circuit producing a time dependent output signal to control the magnitude of electrical current passing through the current regulating means to the lamp.

4. The system of claim 2 further including a dimmer control circuit connected between the switching means and the electrically controllable current regulating means for controlling the magnitude of electrical current supplied to the lamp.

5. The system of claim 4 wherein the said control switch means for responding to a touch from a user to produce an electrical pulse for input to the switching means is incorporated into the said lamp.

6. A system for controlling application of electrical current to a lamp or the like connected to a conventional wall receptacle controlled by a wall mounted power switch for controlling the application of an electrical power source to said wall receptacle, comprising:

a control module formed to be connected between the wall receptacle and the lamp without modifying the wiring between said wall receptacle and said wall mounted power switch, said control module further comprising:

a power supply for connection to the power switch;

a power-on reset circuit connected to the power supply to receive electrical power therefrom for producing a reset pulse in response to a flashing of the power switch to produce a momentary interruption and immediate subsequent resumption of the flow of electrical power from the source of electrical power to the power supply;

a flip-flop having a first input terminal and a second input terminal, the first input terminal connected to the power-on reset circuit to receive the reset pulse therefrom;

a touch control circuit connected to the second input of the flip-flop, the touch control circuit being responsive to a touch from a user to produce a control pulse for input to the flip-flop, the flip-flop being responsive to the reset pulse and the control pulse circuit to produce a switching signal;

a zero crossing detector connected to the flip-flop to receive the switching signal to produce a detector output signal in response to zero crossings of the switching signal; and a triac connected between the source of electrical power and the lamp bulb, the triac being controlled by the detector output to selectively provide electrical power to the lamp bulb so that the lamp bulb may be energized by actuation of either the touch control circuit, or the power switch after having been de-energized by actuation of either the touch control circuit, or the power switch.

7. A method for controlling application of electrical current to a lamp or the like, connected to a conventional wall receptacle controlled by a wall mounted power switch for controlling the application of an electrical power switch to said wall receptacle, comprising the steps of:

connecting a control module formed to be connected between the wall receptacle and the lamp without modifying the wiring between said wall receptacle and said wall mounted power switch;

connecting a power supply to a source of electrical power;

connecting a power-on reset circuit to an output of the power supply to produce a reset pulse in response to momentary interruption of the flow of electrical current from the electrical power source to the power supply;

supplying the reset pulse from the power-on reset circuit to a switching circuit which produces a switching signal in response to the reset pulse;

connecting a control switch which produces a control pulse in response to manual actuation by a user to control the output of the switching circuit;

detecting changes in the output of the switching circuit; and regulating the flow of electrical current to the lamp in response to detected changes in the output of the switching circuit.

* * * * *